US007270737B2

(12) United States Patent
Picard et al.

(10) Patent No.: US 7,270,737 B2
(45) Date of Patent: Sep. 18, 2007

(54) PROCESS FOR DESULFURIZATION COMPRISING A STAGE FOR SELECTIVE HYDROGENATION OF DIOLEFINS AND A STAGE FOR EXTRACTION OF SULFUR-CONTAINING COMPOUNDS

(75) Inventors: Florent Picard, Saint Symphorien d'Ozon (FR); Raphaël Huyghe, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 433 days.

(21) Appl. No.: 10/705,868

(22) Filed: Nov. 13, 2003

(65) Prior Publication Data

US 2004/0094455 A1 May 20, 2004

(30) Foreign Application Priority Data

Nov. 14, 2002 (FR) ..... 02 14273

(51) Int. Cl.
*C10G 67/04* (2006.01)

(52) U.S. Cl. ..... 208/97; 208/144; 208/208 R; 208/211; 208/237; 208/255

(58) Field of Classification Search ..... 208/97, 208/144, 208 R, 211, 237, 255
See application file for complete search history.

(56) References Cited

U.S. PATENT DOCUMENTS 3,200,165 A 8/1965 Wirth et al.
3,309,307 A * 3/1967 Bryant, Jr. ..... 208/144
3,457,163 A * 7/1969 Parker ..... 208/255
6,358,402 B1 * 3/2002 Schucker ..... 208/237
6,551,502 B1 * 4/2003 Lee et al. ..... 208/211
2002/0153280 A1 10/2002 Didillon et al.

FOREIGN PATENT DOCUMENTS

EP 1077247 A 2/2001
FR 88312 1/1967
JP 07242570 A 1/1996

OTHER PUBLICATIONS

Patent Abstracts of Japan 07242570, publication date Sep. 19, 1995.

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

For desulfurization of a hydrocarbon-containing feedstock, at least one stage for selective hydrogenation of diolefins present in the initial hydrocarbon feedstock, in the presence of a catalyst of group VIII of the period table, and a stage for extraction by a solvent of the resultant hydrogenated fraction under conditions that provide at least two fractions:

a raffinate that comprises for the most part olefins, paraffins and naphthenes and a reduced amount of sulfur-containing compounds that are contained in the initial feedstock, a fraction that contains the majority of the aromatic hydrocarbons and the majority of the sulfur-containing compounds contained in the initial feedstock.

21 Claims, 1 Drawing Sheet

PROCESS FOR DESULFURIZATION COMPRISING A STAGE FOR SELECTIVE HYDROGENATION OF DIOLEFINS AND A STAGE FOR EXTRACTION OF SULFUR-CONTAINING COMPOUNDS

This invention relates to a process that makes it possible to reduce the sulfur contents contained in general in hydrocarbons and more particularly in gasolines.

The future specifications on the automobile fuels call for a large reduction in the sulfur content in these fuels, and in particular in gasolines. This reduction is intended to limit in particular the sulfur oxide and nitrogen oxide content in automobile exhaust gases.

European legislation refines the specifications of gasoline fuels that are since 2000: 150 ppm of sulfur, 1% benzene, 42% aromatic compounds, and 18% olefins, and will be in 2005: 50 ppm of sulfur and 35% aromatic compounds. The changes in standards also exist in the United States that call for a production of gasoline with 30 ppm of sulfur by 2004.

The evolution of the specifications of sulfur content in the fuels thus requires the development of new processes for deep desulfurization of gasolines.

The main sulfur sources in the bases for gasolines are so-called cracking gasolines and primarily the gasoline fraction that is obtained from a catalytic cracking process of a residue of atmospheric distillation or under vacuum of a crude oil. The gasoline fraction that is obtained from catalytic cracking, which represents on average 40% of gasoline bases, actually contributes for more than 90% to the input of sulfur into the gasolines. Consequently, the production of low-sulfur gasolines requires a stage for desulfurization of catalytic cracking gasolines. Among the other high-sulfur gasoline sources are also cited coker gasolines, or, to a lesser extent, the gasolines that are obtained from atmospheric distillation or steam-cracking gasolines. This invention is used in particular in the treatment of such gasolines.

The desulfurization is conventionally carried out by one or more stages for bringing into contact sulfur-containing compounds that are contained in said gasolines with a gas that is high in hydrogen into a so-called hydrodesulfurization process in which the organic sulfur is transformed into H2S (hydrogen sulfide) and separated from gasoline. The processes that are currently used are in general hydrogen-intensive, in particular for reaching high desulfurization rates. In this context, it should be anticipated that the control of hydrogen flow within the refinery will become critical when the future specifications in sulfur are instituted.

A current approach consists in, for example, selecting a distillation cutpoint of an FCC gasoline so as to obtain a light fraction that contains a minority of sulfur and a heavier fraction that contains a majority of aromatic heavy hydrocarbons as well as most of the sulfur-containing compounds. The cutpoint is generally selected such that the heaviest sulfur-containing compounds, for example the thiophene derivatives, are found for the most part in the heavy fraction. Said heavy fraction then feeds a hydrodesulfurization unit (HDS), in which the sulfur-containing compounds are eliminated under the action of a reducing stream, most often of hydrogen. The major drawback of such a process is, however, the inevitable joint hydrogenation of olefins that are present in said fraction. Actually, the octane rating of gasolines is very strongly linked to their olefin content. The preservation of the octane rating of gasolines during desulfurization stages requires limiting to a maximum the hydrogenation reactions of olefins into paraffins, unfortunately inherent to the hydrodesulfurization processes.

In summary, when the gasoline is desulfurized in a conventional way, the saturation (or hydrogenation) reactions of olefins that are produced parallel to the reactions for transformation of sulfur-containing compounds into H2S inevitably lead to a high loss in octane rating as well as a high consumption of hydrogen. In a context of restriction of sulfur standards in the gasolines, the use of such processes proves impossible because they would lead, to reach the desired desulfurization rates, to incompatible octane losses.

Among the other methods for desulfurization of gasolines, the processes for extraction by solvent can be used to produce, on the one hand, a gasoline that is high in olefins, paraffins and naphthenes (a fraction that is called a raffinate), and, on the other hand, a gasoline that is high in aromatic compounds and sulfur (a fraction that is called an extract). U.S. Pat. No. 6,358,402 indicates how, by a thermodynamic approach, to select and optimize the solvent that is used for an extractive distillation.

Patent WO 01/59033 teaches a method for producing a desulfurized gasoline that comprises a stage for extracting sulfur-containing compounds that is intended to concentrate the sulfur-containing compounds in a fraction that is high in aromatic compounds and low in olefins (called an extract fraction) and to collect a light fraction (called a raffinate) that contains a minority of sulfur. The extraction method that is used can be a liquid/liquid extraction, or an extractive distillation. According to its inventors, said method would present a better effectiveness for the extraction of sulfur-containing compounds. However, in view of the rigor of the upcoming standards as described above, it seems doubtful that said method can make it possible to reach adequate desulfurization levels, a non-negligible amount of sulfur-containing compounds (85-100 ppm) being found in the raffinate.

This invention relates to an improved process for desulfurization of a hydrocarbon-containing feedstock, for example a gasoline feedstock, comprising at least the following stages:

a) a selective hydrogenation of diolefins that are present in said initial hydrocarbon feedstock in the presence of a catalyst of group VIII of the periodic table, in the presence of an amount of hydrogen that slightly exceeds the stoichiometric value that is necessary for hydrogenating all of said diolefins, b) an extraction by a solvent of said hydrogenated fraction under conditions that make it possible to obtain at least two fractions:

- a raffinate that comprises the majority of olefins, paraffins and naphthenes and a reduced amount of sulfur-containing compounds that are contained in the initial feedstock,
- a fraction that contains the majority of aromatic hydrocarbons and the majority of the sulfur-containing compounds that are contained in the initial feedstock.

Within the meaning of this description, the majority of olefins, paraffins, and naphthenes is defined as meaning that the sum of these hydrocarbon-containing compounds represents at least 50% by weight, preferably at least 70% by weight, and very preferably at least 80% by weight of said raffinate. Within the meaning of this description, a reduced amount of sulfur-containing compounds is defined as meaning that the total amount of sulfur is less than 20%, preferably less than 10% by weight of the total amount of sulfur that is present in the initial feedstock.

According to the invention, the majority of aromatic hydrocarbons or the majority of sulfur-containing compounds is defined as meaning that the sum of these compounds represents at least 50% by weight, preferably at least 70% by weight and very preferably at least 80% by weight, and even at least 90% by weight respectively of the aromatic hydrocarbons that are contained in the initial feedstock or sulfur-containing compounds that are contained in said feedstock.

This invention makes it possible in particular to reduce substantially the amount of sulfur-containing compounds that are present in a hydrocarbon feedstock, typically a gasoline feedstock, and it constitutes a simple and economical way to meet future specifications as far as fuels are concerned. According to this invention, it thus seems possible to considerably reduce the level of diolefins but also to considerably reduce the level of sulfur that is present in a feedstock while increasing hydrogen consumption to only a very limited extent.

In the process according to the invention, preferably said fraction that contains the majority of sulfur-containing compounds is treated in a hydrodesulfurization unit, and more preferably, the extraction is selected from the group that consists of extractive distillations and liquid-liquid extractions.

The invention also relates to the use of the process according to the invention for the treatment of gasolines that are obtained from processes of fluidized-bed cracking (FCC), steam-cracking, coking, visbreaking or a mixing of gasolines obtained from these processes and in particular the use of the process according to the invention for the treatment of gasolines with a higher boiling point of less than 220° C.

Figure 1:
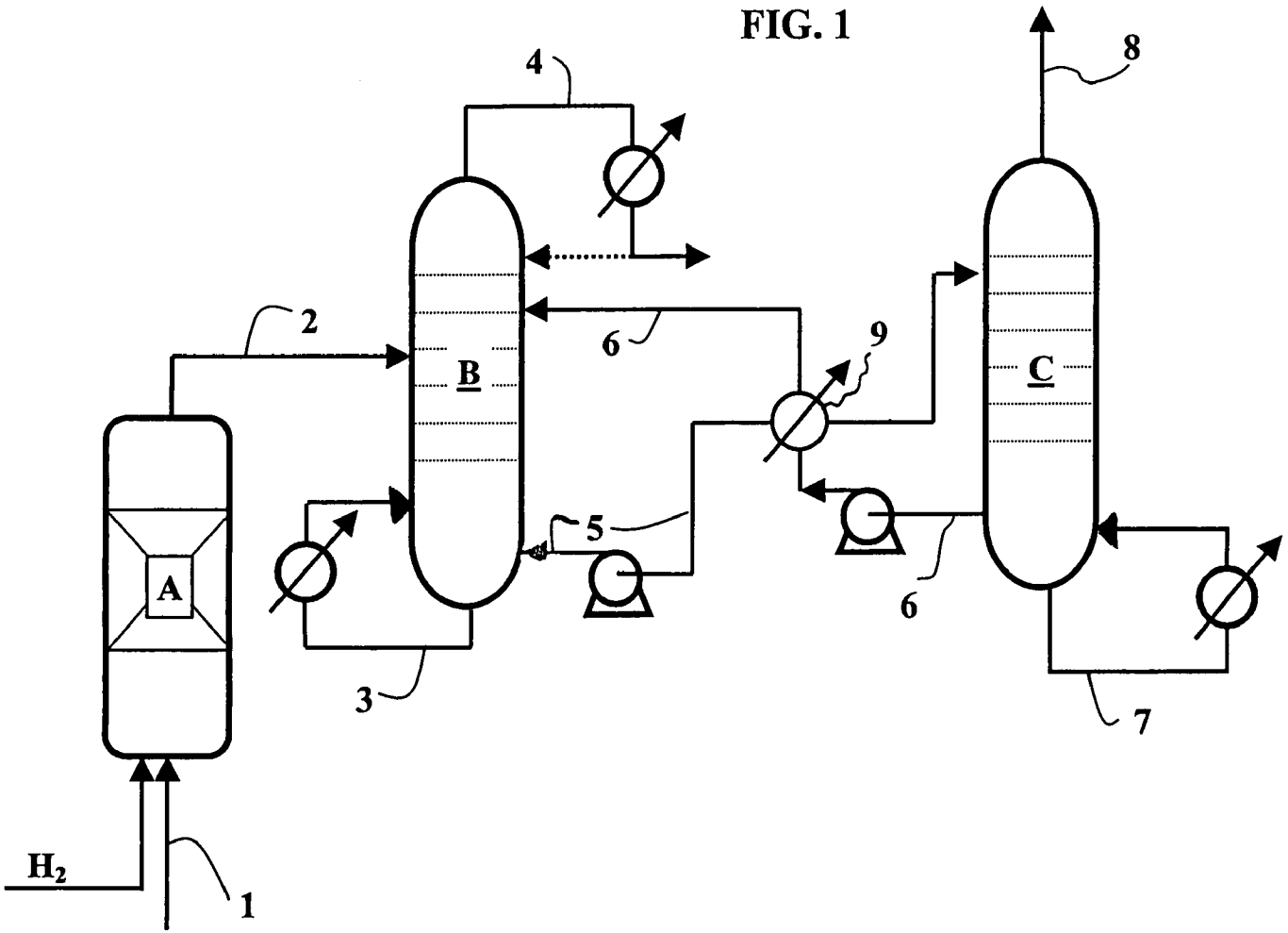
FIG. 1 is a schematic flowsheet of an embodiment of the invention.

The invention will be better understood by reading the following embodiment of the invention, whereby it is understood that this invention is in no way limited, however, to this particular embodiment. This embodiment is illustrated by FIG. 1.

The initial feedstock is introduced via line 1 into a selective hydrogenation reactor A.

This selective hydrogenation stage a) is traditionally intended to eliminate at least partially the diolefins (dienes) that are present in the gasoline. The diolefins are known, for example, for being precursors of gums that polymerize during subsequent treatments, limiting, for example, the service life of the etherification reactors.

This stage takes place in the presence of a catalyst that comprises a substrate and at least one-metal of group VIII, preferably selected from the group that consists of platinum, palladium and nickel. A catalyst that contains 1 to 20% by weight of nickel that is deposited on an inert substrate, such as, for example, alumina, silica, silica-alumina, a nickel aluminate or a substrate that contains at least 50% alumina, will be used. This selective hydrogenation is most often used under a pressure of 0.4 to 5 MPa, at a temperature of between 50 and 300° C., with an hourly volumetric flow rate of the feedstock of between 1 $h^{-1}$ and 12 $h^{-1}$. At least one other metal of group VIB optionally can be combined to form a bimetallic catalyst, such as, for example, molybdenum or tungsten. This metal of group VIB, if it is combined with the metal of group VIII, can be deposited at a rate of 1% by weight to 20% by weight on the substrate.

The selection of operating conditions is particularly important. The operation generally will be performed under pressure in the presence of an amount of hydrogen that slightly exceeds the stoichiometric value that is necessary to hydrogenate the diolefins that are present in the feedstock. Within the meaning of this description, slightly exceeding is defined as meaning that the molar ratio between the hydrogen and the diolefins in stage a) is generally between 1 and 10 and preferably between 1.2 and 5. The hydrogen and the feedstock to be treated are injected in upward or downward streams in a reactor preferably with a fixed catalyst bed. The temperature most generally is between 50 and 300° C., preferably between 80 and 250° C., and more preferably between 120 and 210° C.

The pressure is selected so as to keep more than 80%, and preferably more than 95%, by weight of the gasoline to be treated in a liquid phase in the reactor; it is most generally between 0.4 and 5 MPa and preferably higher than 1 MPa. An advantageous pressure is between 1 to 4 MPa inclusive.

The volumetric flow rate is generally on the order of 1 to 12 $h^{-1}$, preferably on the order of 2 to 10 $h^{-1}$.

The initial gasoline fraction to be treated according to the invention can contain up to several % by weight of diolefins. After hydrogenation, the diolefin content is reduced to less than 3000 ppm, and even less than 2500 ppm and, better, less than 1500 ppm. In some cases, less than 500 ppm can be obtained. The diene content after selective hydrogenation can even be reduced, as required, to less than 250 ppm.

According to an embodiment of the invention, catalytic hydrogenation reactor A comprises a catalytic reaction zone through which passes the entire feedstock and the amount of hydrogen that is necessary for carrying out the desired reactions.

The effluent that is obtained from reactor A is then introduced via line 2 (stage b)) into an extractive distillation column B with a supply tray, not shown in FIG. 1). During this stage b), a solvent that is called an entrainer in the description below is injected above the supply tray of the distillation column.

Stage b) is used under conditions that make possible the separation of sulfur-containing compounds and aromatic compounds from non-aromatic compounds of the FCC fraction, pretreated by selective hydrogenation. According to the invention, the extraction method that is being considered can be a liquid/liquid extraction or preferably an extractive distillation that generally exhibits a better effectiveness for the extraction of the sulfur-containing compounds.

For example, if an extractive distillation is introduced, excess hydrogen of stage A will be eliminated by purging at the top of column B (not shown in FIG. 1). This purging will have as its object in particular to regulate the vapor pressure of the gasoline that is produced.

The operating parameters of the extractive distillation column are selected according to criteria known to one skilled in the art by taking into account, for example, the following considerations:

- the temperature at the bottom of the column is governed by the reboiling rate, illustrated by circuit 3. The usable heat at the reboiler depends primarily on the composition of the bottom of the column (essentially containing heavy compounds of the feedstock and solvent) and the nature of the solvent.
- The temperature at the top of the column is preferably kept at a temperature that is higher than the dew point of the top flow.
- The pressure range to be considered during the distillation can be as wide as possible, preferably being between 0.01 and 1 MPa relative and preferably between 0.03 and 0.7 MPa relative. The pressure is selected to ensure the desired separation, namely to extract the sulfur-containing compounds and aromatic compounds from the feedstock, by bringing it into contact with a solvent.

The introduction of the entrainer into column B has the primary result of modifying the relative volatilities of the components of the feedstock. The entrainer is in principle a solvent that has a boiling point that is higher than the components of the feedstock. It entrains with it the sulfur-containing compounds and aromatic compounds in the extract that is drawn off at the bottom of the column by a pipe 5. The separation of the solvent and entrained components is then done in regeneration column C, fed by said pipe 5.

At the top of column B, a raffinate that exhibits a very low sulfur concentration, able to be used, directly or after an intermediate treatment that is aimed at, for example, increasing its octane rating, as a gasoline base, is recovered via a line 4. The compounds such as olefins, paraffins, and naphthenes that are present in the initial feedstock are not entrained by the solvent and constitute the majority of the components of the raffinate from the separation. The sulfur-containing compounds that are being considered in said invention are primarily mercaptans, sulfides, bisulfides, thiophenes, benzothiophenes and dibenzothiophenes. The extract, comprising a strong concentration of sulfur, can then be treated with any hydrodesulfurization process (HDS) that is known to one skilled in the art.

The solvents that are generally used within the scope of this invention are selected based on their affinity for the aromatic compounds and the sulfur-containing compounds. They make it possible to extract the sulfur-containing compounds from the feedstock by concentrating them in the extract, while rejecting the olefins in the raffinate. The selectivity and the solvent power (solubility of compounds in said solvent) regarding sulfur-containing compounds and aromatic compounds are the two primary characteristics that are required for the selection of the solvent. The solvent will be selected in particular based on criteria that are well known by one skilled in the art, for example according to the principles that are described in U.S. Pat. No. 6,358,402, and preferably should have a high boiling point so as to limit the losses of solvent by volatility and to reduce the degradation phenomena of said solvent within the regeneration column.

Furthermore, the list below, non-exhaustive, provides a series of solvents that can be used for carrying out said separation. The solvent of the process according to the invention preferably is thus selected from the group that consists of the following compounds:

Sulfolane, 3-methylsulfolane, 2,4-dimethylsulfolane, 3-methylsulfolane, 3-ethylsulfolane, N-methyl-pyrrolidone, 2-pyrrolidone, N-ethyl-pyrrolidone, N-propyl-pyrrolidone, N-formyl-morpholine, dimethylsulfone, diethylsulfone, methylethylsulfone, dipropylsulfone, dibutylsulfone, tetraethylene glycol, triethylene glycol, dimethylene glycol, ethylene glycol, ethylene carbonate, and propylene carbonate.

The recommended solvents are very preferably sulfolane, 3-methylsulfolane, N-formyl morpholine, 2-pyrrolidone, dipropylsulfone and tetraethylene glycol.

The solvent is regenerated in regeneration column C. Column C is a standard distillation column that makes it possible to extract the aromatic compounds and the sulfur-containing compounds that are initially present in the extract at the top via a line 8 and to extract the solvent that is selected most often at the bottom such that its boiling point is higher than that of the distillation end point of the treated feedstock (of the extract).

The reboiling rate in regeneration column C is illustrated by circuit 7.

In the embodiment that is illustrated by FIG. 1, the recycled solvent is then sent to stage b) for extraction via a line 6. Furthermore, an exchanger 9 can be provided for the heat exchange between the extract that is obtained from column B and the regenerated solvent that is obtained from column C.

The sulfur-containing aromatic gasoline that is recovered at the top of regeneration column C can be treated by hydrodesulfurization by any standard process that is known to one skilled in the art (not shown). Taking into account the very aromatic nature of this fraction, said hydrodesulfurization can be carried out under quite rigorous conditions, i.e., under a greatly reducing atmosphere without a risk of hydrogenation of aromatic cycles, which is detrimental to the final octane rating.

The aromatic compounds can also be upgraded for possible uses in petrochemistry.

This process thus exhibits numerous advantages. The effluent that is obtained at the top of column B (raffinate) exhibits a very low sulfur content (essentially non-thiophenic light sulfur-containing compounds) that is in most cases compatible with the most rigorous standards, thus permitting its direct use as a base for gasoline without an additional desulfurization stage. In contrast, the extract consists of a large majority of aromatic hydrocarbons (60-90% by weight) with a high octane rating; its desulfurization can therefore be conducted under fairly permissive conditions without a risk of substantial reduction of said rating, which makes it possible to greatly reduce the overall facility cost.

The following examples will make it possible for one skilled in the art to evaluate the advantages of the process according to the invention. Example 1 relates to a process in which an extractive distillation is used on a feedstock, and Example 2 illustrates the invention according to which a selective hydrogenation is carried out prior to said extractive distillation.

EXAMPLE 1 (FOR COMPARISON)

A gasoline E1 that is obtained from a catalytic cracking unit and that contains 1318 ppm of sulfur of which 116 ppm of mercaptans is treated. Its characteristics are presented in detail in Table 1.

TABLE 1

| | Gasoline E1 % by weight |
|---|---|
| n-Paraffins | 3.2 |
| i-Paraffins | 20.8 |
| Naphthenes | 6.1 |
| Aromatic Compounds | 32.4 |
| Olefins | 37.5 |
| Total S (ppm) | 1318 |
| MAV (mg/g) | 17 |
| Simulated Distillation | |
| % by weight | Temperature (° C.) |
| Starting Point | 16 |
| 5% | 23 |
| 10% | 33 |
| 20% | 40 |
| 30% | 70 |
| 40% | 87 |

TABLE 1-continued

| | |
|---|---|
| 50% | 111 |
| 60% | 126 |
| 70% | 140 |
| 80% | 162 |
| 90% | 183 |
| End Point | 231 |

The hydrocarbon composition as well as the simulated distillation were determined by gas phase chromatography. The total sulfur is quantified by fluorescence X, and the mercaptans are determined by potentiometry according to the ASTM method D 3227-92. The level of diolefins was determined by reaction of said feedstock with the maleic acid according to a MAV (maleic acid value) technique that is known to one skilled in the art. The values that are listed in Table 1 correspond to the number of milligrams of maleic anhydride that have reacted with 1 gram of the sample.

A distillation of said feedstock is used in a flask that is equipped for this purpose and heated to total reflux at 155° C., at atmospheric pressure. The gasoline is mixed with sulfolane in a ratio of volumes of gasoline and sulfolane of 2.

A sample (raffinate R1) of the evaporated fraction is taken when the evaporation equilibrium is reached.

The results of the analyses carried out on the collected raffinate are presented in Table 2. The respective proportions of the different hydrocarbon families are expressed in percentage by weight, the total sulfur (total S) in parts per million (ppm).

TABLE 2

| | Feedstock (E) | Raffinate (R1) |
|---|---|---|
| n-Paraffins | 3.2 | 4.3 |
| i-Paraffins | 20.8 | 33.3 |
| Naphthenes | 6.1 | 3.1 |
| Aromatic Compounds | 32.4 | 5.5 |
| Olefins | 37.5 | 53.8 |
| Total S (ppm) | 1318 | 118 |
| MAV (mg/g) | 17 | 9 |

Raffinate R1 that is collected in the evaporated fraction contains 118 ppm of sulfur, which represents a 91% reduction of the sulfur content. This gasoline is high in olefins and paraffins and low in aromatic compounds. The diolefin content that is determined by the MAV technique is 9 mg/g.

The presence of sulfolane therefore makes it possible to modify the boiling points of sulfur-containing compounds and aromatic compounds and to concentrate the sulfur in the aromatic fraction that is low in olefins.

EXAMPLE 2 (ACCORDING TO THE INVENTION)

The same gasoline E1 as that of Example 1 is first treated during a first selective hydrogenation stage. This stage is carried out on a pilot unit that contains 100 ml of a substrate NiMO catalyst marketed by the Axens Company under reference HR845®. Said selective hydrogenation is carried out at a temperature of 160° C., under an hourly volumetric flow rate (expressed in terms of the volume of feedstock per volume of catalyst and per hour) of 4 $h^{-1}$ and with an H2/HC ratio between the hydrogen flow rate that is expressed in liters in normal conditions, and the gasoline flow rate that is expressed in liters at 20° C., of 7 liters/liter.

This pretreatment stage makes it possible to recover a gasoline whose characteristics are provided in Table 3. Gasoline E2 differs from gasoline E1 essentially by a lower diolefin content.

Gasoline E2 is then treated according to the same extraction procedure as the one applied for Example 1. Gasoline E2 is mixed with sulfolane. The ratio of the volumes of gasoline and sulfolane is 2.

A sample (raffinate R2) of the evaporated fraction that is called a raffinate is taken when the evaporation equilibrium is reached.

The results of analyses carried out on the collected raffinate are presented in Table 3.

TABLE 3

| | Feedstock | Gasoline (E2) | Raffinate (R2) |
|---|---|---|---|
| n-Paraffins | 3.2 | 3.3 | 4.4 |
| i-Paraffins | 20.8 | 21.6 | 34.7 |
| Naphthenes | 6.1 | 6.3 | 3.2 |
| Aromatic Compounds | 32.4 | 32.6 | 5.5 |
| Olefins | 37.5 | 36.3 | 52.2 |
| Total S (ppm) | 1318 | 1314 | 27 |
| MaV | 17 | 1.9 | 0.9 |

Raffinate R2 exhibits a sulfur content of 27 ppm for a higher olefin content at 50% by weight. The treatment that is carried out according to the invention therefore makes it possible to reach a desulfurization level of 97.9%, which is higher than the performance levels of Example 1, without significantly reducing the olefin content relative to raffinate R1. Furthermore, the gasoline that is produced is low in diolefins, which limits the risks of clogging by formation of gums during any subsequent treatment.

The preceding examples can be repeated with similar success by substituting the generically or specifically described reactants and/or operating conditions of this invention for those used in the preceding examples.

The entire disclosures of all applications, patents and publications, cited herein and of corresponding French application No. 02/14.273, filed Nov. 14, 2002, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claim is:

1. A process for desulfurization of a gasoline feedstock obtained from a fluidized-bed catalytic cracking (FCC) operation comprising at least the following stages:

a) a selective hydrogenation of diolefins present in said initial gasoline feedstock in the presence of a catalyst comprising a metal of group VIII of the periodic table, in the presence of an amount of hydrogen that slightly exceeds the stoichiometric value necessary for hydrogenating all of said diolefins, said selective hydrogenation being conducted under sufficient pressure to keep more than 80% of the gasoline feedstock in the liquid phase, b) an extraction by a suitable solvent of resultant hydrogenated fraction under conditions so as to obtain at least two fractions:

a raffinate comprising for the most part olefins, paraffins and naphthenes and a reduced amount of sulfur-containing compounds that are contained in the initial feedstock, a fraction that contains said solvent and the majority of aromatic hydrocarbons and the majority of the sulfur-containing compounds contained in the initial feedstock.

2. A process according to claim 1, in which the molar ratio between the hydrogen and the diolefins in stage a) is between 1 and 10.

3. A process according to claim 1, in which said group VIII catalyst comprises at least one metal selected from the group that consists of platinum, palladium, and nickel.

4. A process according to claim 3, in which said catalyst also comprises at least one metal of group VIB of the periodic table, thereby providing a bimetallic catalyst.

5. A process according to claim 1, further comprising distilling said fraction containing solvent, aromatics and sulfur-containing compounds so as to obtain regenerated solvent which is recycled to the extraction step and a bottom stream rich in sulfur-containing compounds and aromatics, and subjecting said bottoms-stream to hydrodesulfurization to recover a gasoline low in sulfur and rich in aromatics.

6. A process according to claim 1, in which said selective hydrogenation conducted under a pressure of about 0.4 to 5 MPa, at a temperature of between about 50 and 300° C., with an hourly volumetric flow rate of the feedstock of between about 1 $h^{-1}$ and 12 $h^{-1}$.

7. A process according to claim 1, in which said extraction is with a solvent is at least one of an extractive distillation and a liquid-liquid extraction.

8. A process according to claim 1, in which said solvent is a compound or a mixture of compounds selected from the group that consists of the following compounds: sulfolane, 3-methylsulfolane, 2,4-dimethylsulfolane, 3-methylsulfolane, 3-ethylsulfolane, N-methyl pyrrol idone, 2-pyrrolidone, N-ethyl-pyrrolidone, N-propyl-pyrrolidone, N-formyl-morpholine, dimethylsulfone, diethylsulfone, methylethylsulfone, dipropylsulfone, dibutylsulfone, tetraethylene glycol, triethylene glycol, dimethylene glycol, ethylene glycol, ethylene carbonate, and propylene carbonate.

9. A process according to claim 1, wherein the hydrocarbon feedstock is a gasoline with a upper boiling point of less than 220° C.

10. A process according to claim 7, wherein the extraction is conducted by extractive distillation, the hydrocarbon feedstock is an FCC gasoline and the solvent comprises at least one of sulfolane, 3-methylsulfolane, N-formyl morpholine, 2-pyrrolidone, dipropylsulfone and tetraethylene glycol.

11. A process according to claim 10, further comprising distilling said fraction containing solvent, aromatics and sulfur-containing compounds so as to obtain regenerated solvent which is recycled to the extraction step and a bottom stream rich in sulfur-containing compounds and aromatics, and subjecting said bottoms stream to hydrodesulfurization to recover a gasoline low in sulfur and rich in aromatics.

12. A process according to claim 1, in which the molar ratio between the hydrogen and the diolefins in stage a) is between 1.2 and 5.

13. A process according to claim 5, wherein the bottoms stream comprises 60-90% by weight of aromatics.

14. A process according to claim 1, wherein said catalyst consists essentially of a nickel-containing catalyst.

15. A process according to claim 13, wherein said catalyst consists essentially of a nickel-containing catalyst.

16. A process according to claim 1, wherein said extraction in step (b) of claim 1 is conducted by extractive distillation.

17. A process according to claim 13, wherein the extraction in step (b) is conducted by extractive distillation and the solvent comprises at least one of sulfolane, 3-methylsulfolane, N-formyl morpholine, 2-pyrrolidone, dipropylsulfone and tetraethylene glycol.

18. A process according to claim 17, wherein the solvent is sulfolane.

19. A process according to claim 1, wherein the resultant hydrogenated fraction from step (a) is passed directly into the extraction stage (b).

20. A process according to claim 1, wherein the FCC gasoline feedstock is passed directly into the hydrogenation stage.

21. A process according to claim 1, wherein the selective hydrogenation is conducted under sufficient pressure to maintain more than 95% by weight of the gasoline feedstock in the liquid phase.

* * * * *

UNITED STATES PATENT AND TRADEMARK OFFICE

CERTIFICATE OF CORRECTION

PATENT NO. : 7,270,737 B2
APPLICATION NO. : 10/705868
DATED : September 18, 2007
INVENTOR(S) : Florent Picard It is certified that error appears in the above-identified patent and that said Letters Patent is hereby corrected as shown below:

Title page Item (75), Inventors: line 2, reads “Lyons” should read -- Lyon --
Column 9, line 19, reads “bottoms-stream” should read -- bottoms stream --
Column 9, line 33, reads “N-methyl pyrrol idone,” should read -- N-methyl pyrrolidone, --

Signed and Sealed this

Twentieth Day of May, 2008

JON W. DUDAS
*Director of the United States Patent and Trademark Office*